US007185781B2

(12) United States Patent
Pitts

(10) Patent No.: US 7,185,781 B2
(45) Date of Patent: Mar. 6, 2007

(54) HOT DRINK CUP LID WITH COOLING AIR-FLOW

(76) Inventor: Constance Linda Pitts, 5748 Clark Rd., West Manchester, OH (US) 45382-9608

( * ) Notice: Subject to any disclaimer, the term of this patent is extended or adjusted under 35 U.S.C. 154(b) by 0 days.

(21) Appl. No.: 10/800,945

(22) Filed: Mar. 16, 2004

(65) Prior Publication Data

US 2005/0205588 A1 Sep. 22, 2005

(51) Int. Cl.
*A47G 19/22* (2006.01)
*B65D 51/16* (2006.01)

(52) U.S. Cl. ..... 220/367.1; 220/713; 220/780; 229/404; 229/906.1

(58) Field of Classification Search ..... 220/367.1, 220/703, 704, 711, 713, 716, 717, 780; 229/404, 229/906.1
See application file for complete search history.

(56) References Cited

U.S. PATENT DOCUMENTS

| | | | | | |
|---|---|---|---|---|---|
| 2,640,337 | A * | 6/1953 | Bryant | 220/704 |
| 4,412,629 | A * | 11/1983 | Dart et al. | 220/711 |
| 4,589,569 | A * | 5/1986 | Clements | 220/380 |
| 4,756,440 | A * | 7/1988 | Gartner | 220/711 |
| 4,899,902 | A * | 2/1990 | DeMars | 220/713 |
| 4,915,250 | A * | 4/1990 | Hayes, Jr. | 220/711 |
| 4,949,865 | A * | 8/1990 | Turner | 220/713 |
| 4,953,743 | A * | 9/1990 | Dart et al. | 220/369 |
| 5,111,961 | A * | 5/1992 | Van Melle | 220/712 |
| 5,613,619 | A * | 3/1997 | Van Melle | 220/712 |
| 5,624,053 | A * | 4/1997 | Freek et al. | 220/713 |
| 5,699,927 | A * | 12/1997 | Lane et al. | 220/254.3 |
| 5,706,972 | A * | 1/1998 | Sousa | 220/714 |
| 5,799,814 | A * | 9/1998 | Schaefer et al. | 220/254.1 |
| 5,839,601 | A * | 11/1998 | Van Melle | 220/712 |
| 5,996,837 | A * | 12/1999 | Freek et al. | 220/713 |
| 6,089,397 | A * | 7/2000 | Van Melle | 220/270 |
| D429,443 | S * | 8/2000 | D'Alessio | D7/392.1 |
| 6,095,033 | A * | 8/2000 | Melton | 99/323.3 |
| 6,176,390 | B1 * | 1/2001 | Kemp | 220/712 |
| 6,305,571 | B1 * | 10/2001 | Chu | 220/719 |
| 6,374,726 | B1 * | 4/2002 | Melton | 99/323 |
| 6,419,105 | B1 * | 7/2002 | Bruce et al. | 220/266 |
| 6,571,973 | B1 | 6/2003 | Tripsianes | |
| 6,578,726 | B1 * | 6/2003 | Schaefer | 220/253 |
| 6,612,456 | B1 * | 9/2003 | Hundley et al. | 220/254.3 |
| 6,644,490 | B2 * | 11/2003 | Clarke | 220/254.1 |
| 6,659,302 | B2 * | 12/2003 | Lin | 220/254.8 |
| D485,758 | S * | 1/2004 | Clarke et al. | D9/447 |
| 6,679,397 | B2 * | 1/2004 | Smith et al. | 220/254.1 |
| 6,889,859 | B1 * | 5/2005 | Leon | 220/254.3 |

* cited by examiner

*Primary Examiner*—Nathan J. Newhouse
*Assistant Examiner*—James Smalley

(57) ABSTRACT

The "HOT DRINK CUP LID WITH COOLING AIR-FLOW" is an article of manufacture with a uniquely designed form arranged so that the hot liquid is cooled by an air-flow drawn over the liquid as it is sipped. The unique design, placement of the drinking hole and cooling air-flow hole create a structure whereby hot liquid can be cooled and sipped in a manner that reduces the temperature of the hot liquid as it transfers from the cup to the user. This cooling action is activated by the suction caused by the action of the user sipping at the drinking hole and concurrently drawing air from outside of the cup down through the air-flow hole and up through the drinking hole along with the hot liquid. Thus the hot liquid is cooled as the air is drawn up in conjunction with the hot liquid through the drinking hole.

4 Claims, 5 Drawing Sheets

Section A-A

HOT DRINK CUP LID WITH COOLING AIR-FLOW

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

This invention is in the field of cup lids for hot beverages and is designed to improve the safety and enjoyment when drinking very hot liquids, such as hot coffee. This new and unique utility invention for an article of manufacture is a tremendous improvement over prior art.

This invention is uniquely different from prior art.

BRIEF SUMMARY OF THE INVENTION

This invention was developed to answer an urgent need by the purveyors and consumers of hot liquid such as hot coffee, hot tea, hot chocolate, etc., when drinking from a cup such as that offered at fast food restaurants, carry-outs, and service mini-marts. When liquids are hot they can burn the lips and inside surface of the mouth. If cooled quickly with such as ice cubes, then they will be cold too soon; if allowed to cool slowly in the cup with some sort of lid, it will be too long before the liquid is drinkable. This is especially apparent when traveling. Therefore I have invented the HOT DRINK CUP LID WITH COOLING AIR-FLOW, which allows air to pass over the hot liquid as it is sipped and thus reducing the temperature of the liquid passing through the drinking opening but not prematurely lowering the temperature of the body of liquid remaining in the cup. This allows the enjoyment of a hot liquid for a longer period of time and increases the safety of drinking hot liquids from a cup with a lid such as the disposable cups and lids offered at fast food restaurants, carry-outs, service mini-marts, and other establishments.

DETAILED DESCRIPTION OF THE INVENTION

Figure 1:
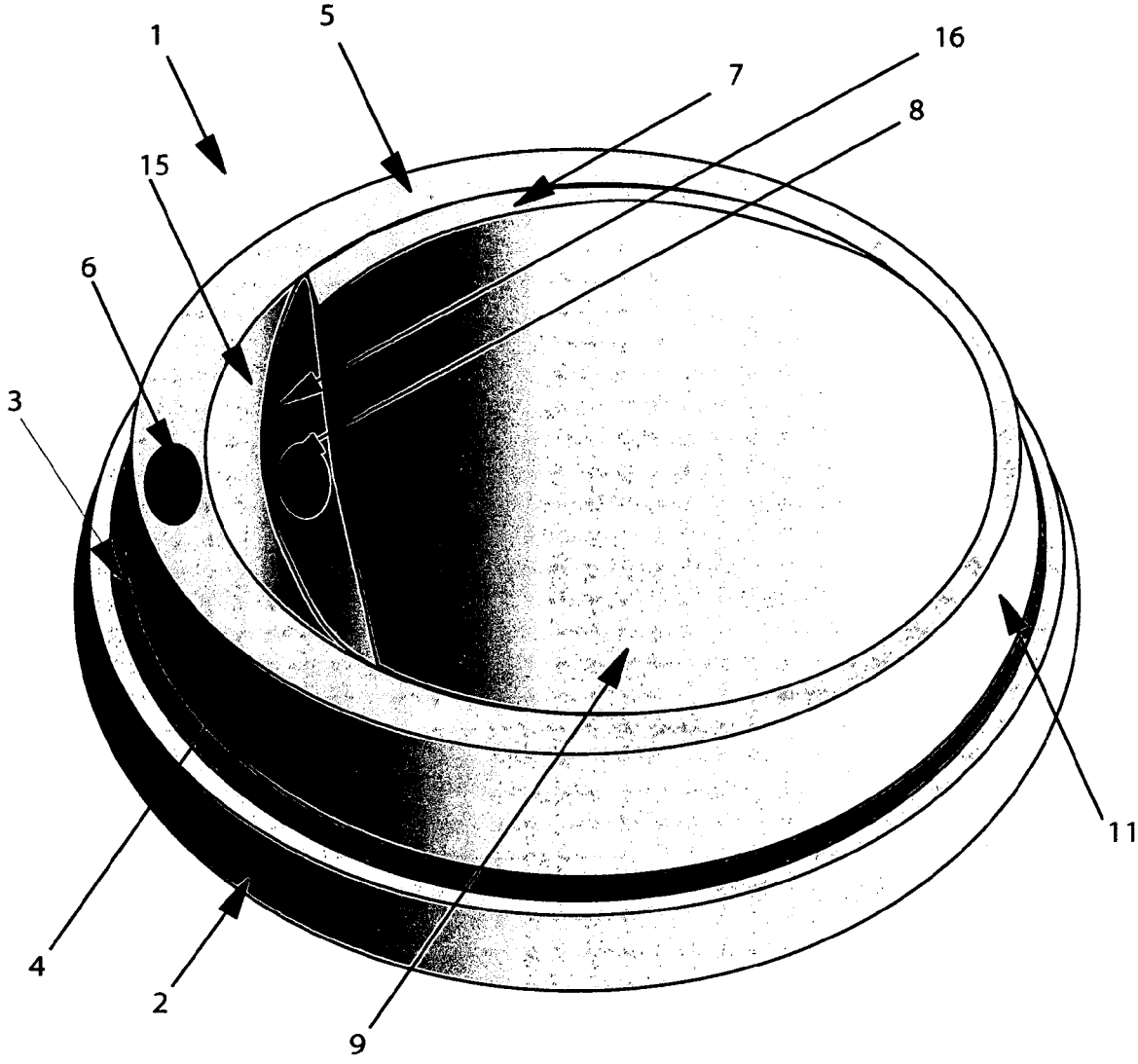
FIG. 1: Perspective

In accordance with the invention, I describe the HOT DRINK CUP LID WITH COOLING AIR-FLOW invention, which provides a lid 1, in FIG. 1, with cooling air-flow hole 8 for use on beverage containers, such as a drinking cup 14. Specifically the lid 1 has a raised central area 4 with a drinking area plane 5 and drinking hole 6 located on one side of the drinking area plane 5. Further, there is an angular raised portion 15 raising away from the drinking hole 6; and the adjacent angular recessed portion 16 which angles down and away from the drinking hole 6. Further, centrally located on the angular recessed portion 16 is the cooling air-flow hole 8. The cooling air-flow hole 8 is located on the same radius as the drinking hole 6, and in a plane slightly lower than the plane of the drinking hole 6. The cooling air is drawn through the cooling air-flow hole 8 and into the open space above the hot liquid/beverage 17 and up through the drinking hole 6, traveling with the hot liquid/beverage 17 out of the drinking hole 6, thus cooling the hot liquid/beverage 17 as the liquid/beverage 17 is being consumed.

The prototype of the lid 1 embodied a raised circular area 4 on which a drinking hole 6 is placed in drinking area plane 5; other forms of embodiment where a raised drinking area is present would be covered by this invention. The prototype of the lid 1 incorporates the raised drinking area plane 5, the drinking hole 6, the recessed cooling air-flow hole 8, and the angular members 9, 15, 16 resulting in a cooling effect of hot liquid/beverages 17 at the exit of the drinking hole 6 yet retaining the interior heat within the cup 14. The cooling air-flow hole 8 is located above the rim of the cup 14 and below the drinking hole 6. The optimum position of the cooling air-flow hole 8 is apparent in FIG. 4 (cross-sectional view).

Figure 5:
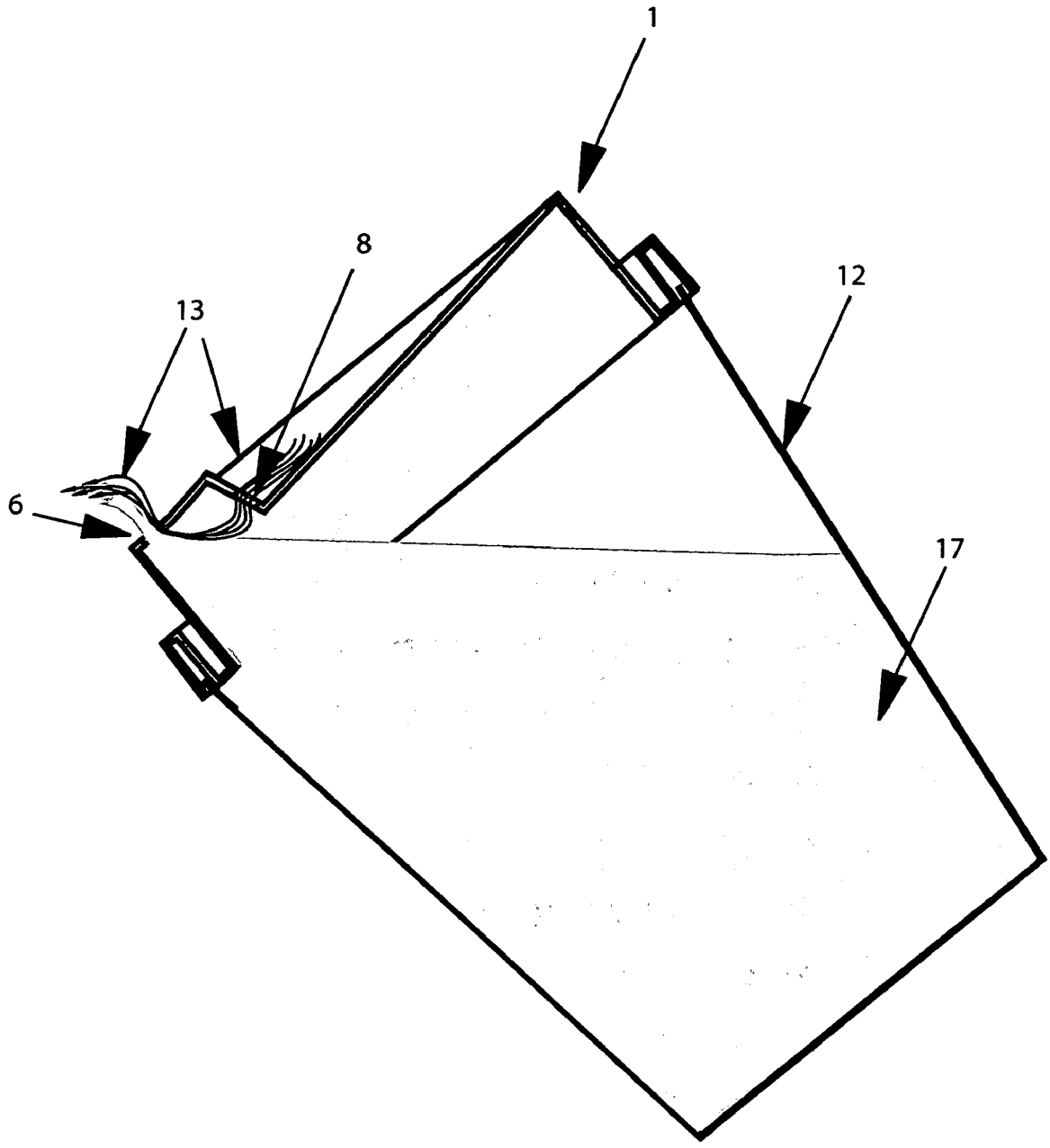
FIG. 5: Diagrammatic of Cooling Action

No know invention or device of prior art utilizes a cooling air-flow hole 8 arrangement of embodiment so as to pass cooling air over hot liquid/beverages 17 as the cup 14 is tilted in at normal drinking angle and the hot liquid/beverage 17 is drawn out through the drinking hole 6, FIG. 5.

DRAWINGS

FIG. 1—Hot Drink Cup Lid with Cooling Air-Flow (Perspective)

Figure 2:
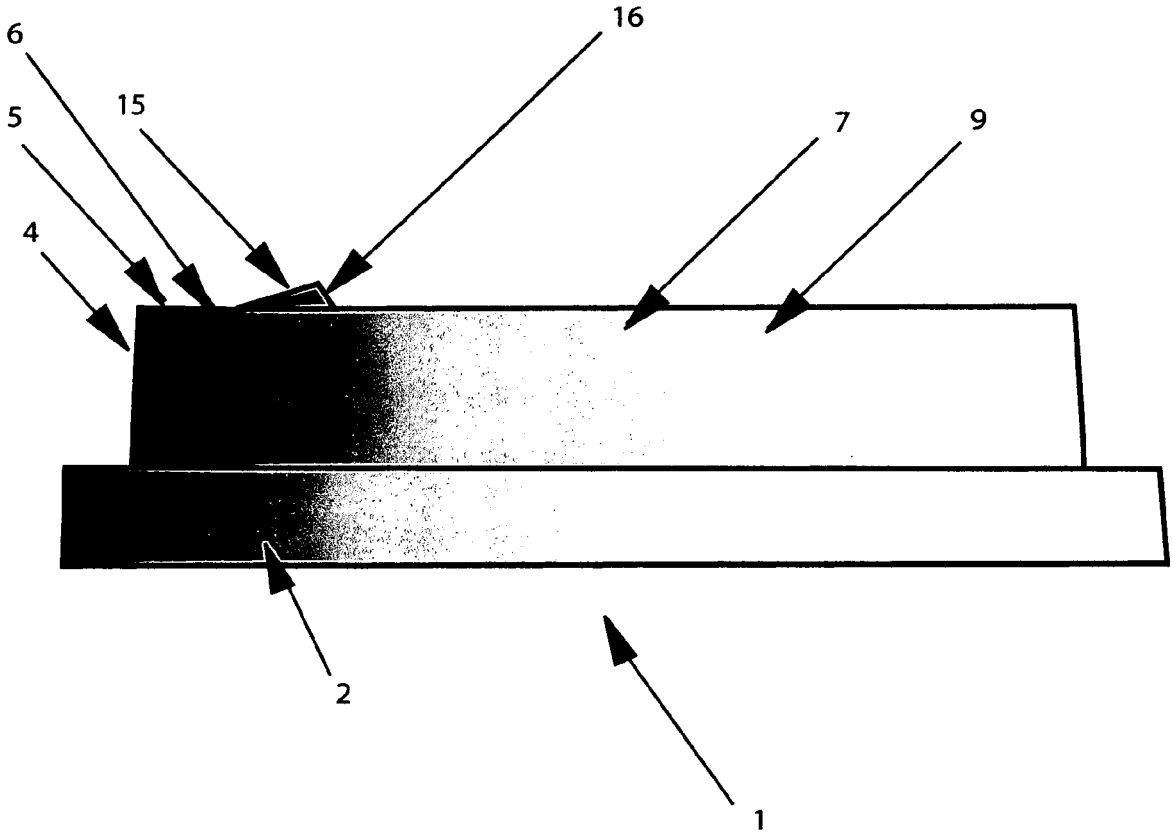
FIG. 2: Side View
Figure 3:
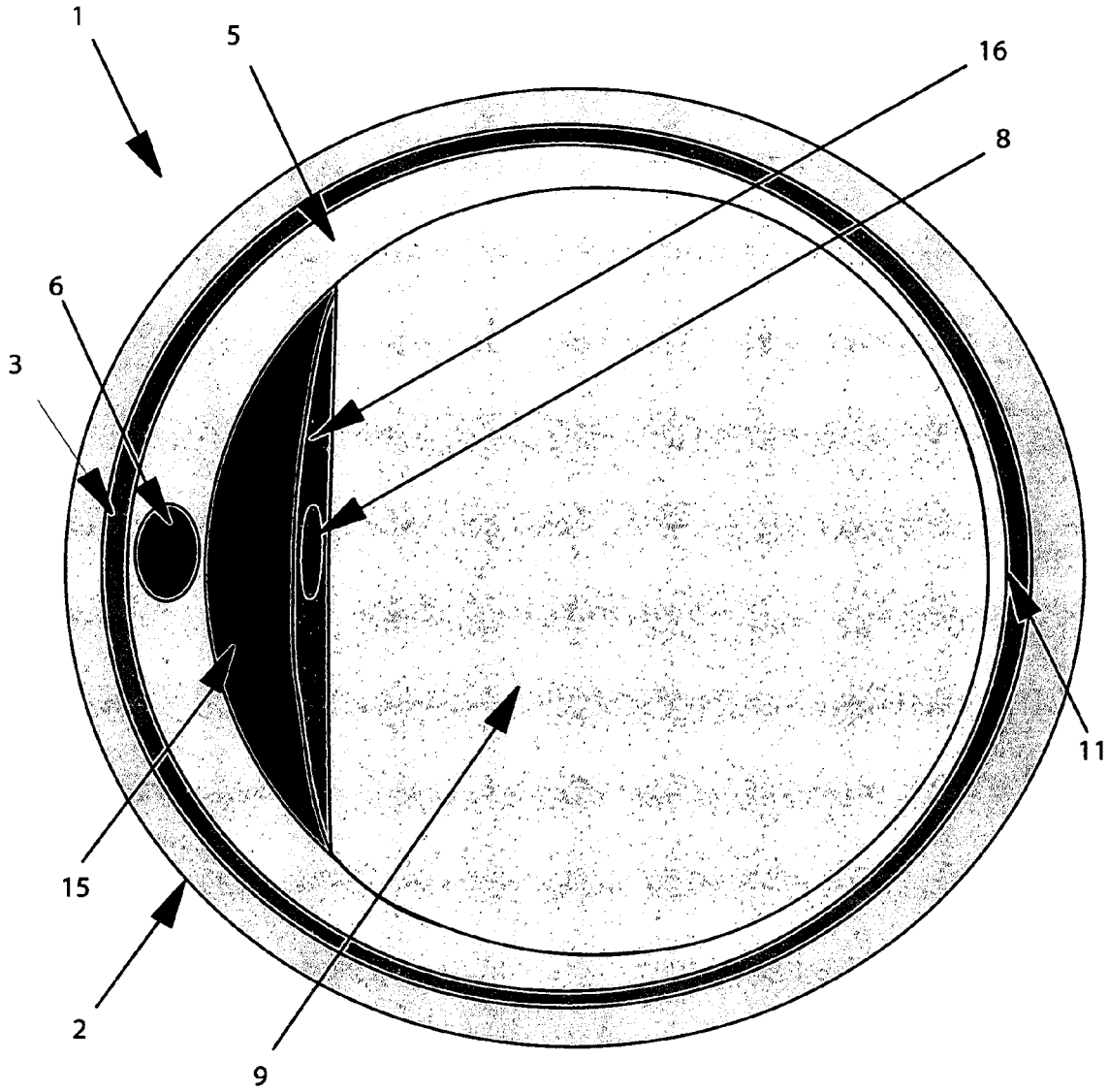
FIG. 3: Top View
Figure 4:
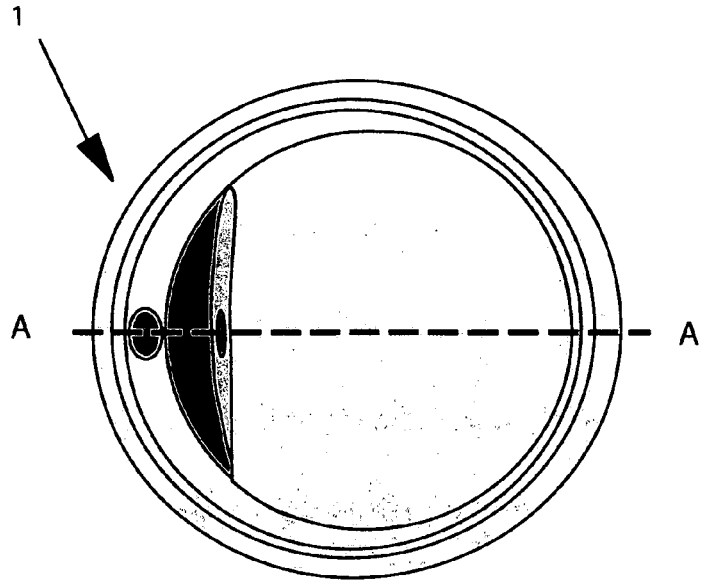
FIG. 4: Cross Section A—A Through Center of Lid
Figure 4:
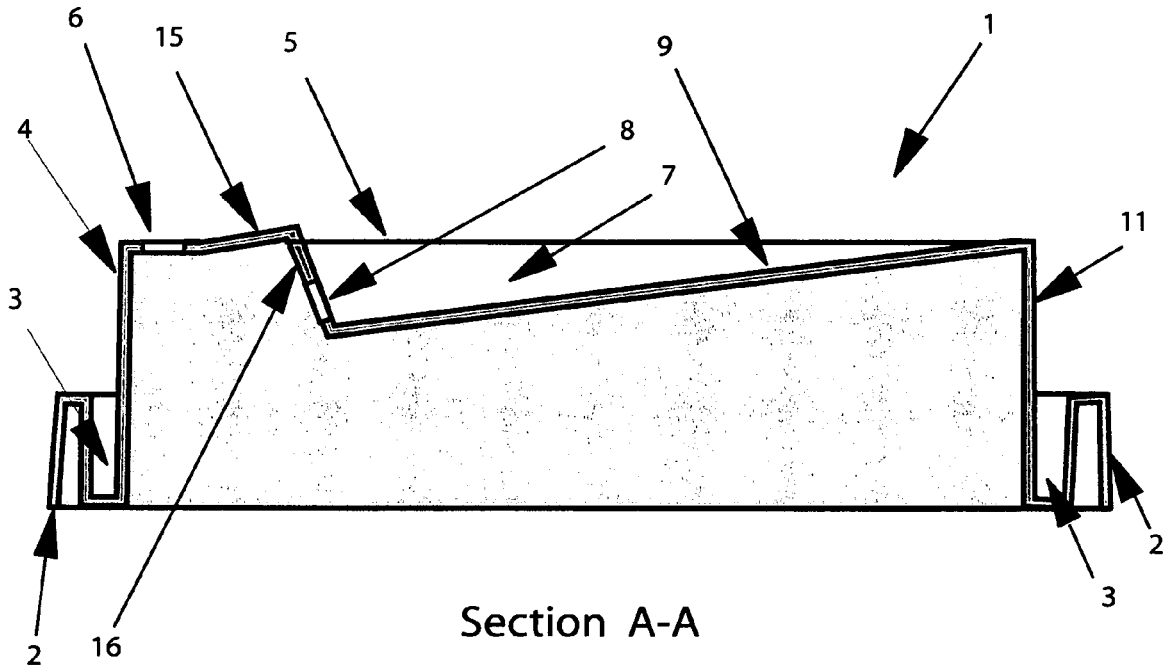

Legend
1. lid
2. mounting portion which mates with the associated container
3. recessed channel
4. raised portion
5. drinking area plane
6. drinking hole
7. recessed portion
8. cooling air-flow hole
9. angled portion
11. raised portion opposite the drinking hole
15. angular raised portion
16. angular recessed portion FIG. 2—Side View Legend
1. lid
2. mounting portion which mates with the associated container
3. recessed channel
4. raised portion
5. drinking area plane
6. drinking hole
7. recessed portion
8. cooling air-flow hole
9. angled portion
15. angular raised portion
16. angular recessed portion FIG. 3—Top View Legend
1. lid
2. mounting portion which mates with the associated container
3. recessed channel
5. drinking area plane
6. drinking hole
8. cooling air-flow hole
9. angled portion
15. angular raised portion
16. angular recessed portion FIG. 4—Sectional View Legend
1. lid
2. mounting portion which mates with the associated container
3. recessed channel
4. raised portion
5. drinking area plane
6. drinking hole
7. recessed portion
8. cooling air-flow hole
9. angled portion
11. raised portion opposite the drinking hole
15. angular raised portion
16. angular recessed portion FIG. 5—Diagrammatic View of Lid in Use.
1. lid
6. drinking hole
8. cooling air-flow hole
13. action path of air and liquid flow
14. cup
17. hot liquid/beverage

What is claimed as my invention is:

1. A lid for a container, comprising of, a uniquely designed and developed formed unit which when snugly and securely mounted on an associated mating container, acts as a cooling device by drawing the cooler outside ambient air into the container through a strategically placed cooling air-flow hole and then this cooler air is drawn up along with the hot liquid as it is sipped through the lid's drinking hole, thus lowering the temperature of the hot liquid by the action of the ambient air outside the cup being pulled down into the cup through the cooling air-flow hole and then continuing up through and out the drinking hole in conjunction with the hot liquid creating a flow though action, a mounting portion for engaging with an associated container to form a snug fit, a raised portion forming a drinking area plane, a drinking hole at the top of the drinking area plane, an angular raised portion adjacent to and raising above and away from the drinking hole area on the side of the drinking area plane containing the drinking hole, an angular recessed portion with its' deepest position at or above the plane of the lid rim and toward the side on which the drinking hole is located, a cooling air-flow hole located in the angular recessed portion and on a plane slightly lower than that of the drinking hole plane and in line along the radius on which the drinking hole is located, a cooling air-flow hole of comparable size to the drinking hole, a cooling air-flow hole located close enough to the drinking hole to allow the cooler ambient air outside of the cup to be pulled into the cup by the vacuum action created by the sipping action when drinking from the drinking hole, a cooling air-flow hole located far enough away from the drinking hole to allow thermodynamic properties to take affect on the hot liquid as the cooler ambient air outside the cup is pulled into the cup and then flows concurrently out of the drinking hole with the hot liquid reducing the temperature of the hot liquid, a gradually raised portion leading away from and opposite to the drinking hole and cooling air-flow hole, a portion returning to a plane at or below the drinking area plane and on the opposite side of said lid, and said HOT DRINK CUP LID WITH COOLING AIR-FLOW being designed for ease in use and economically viable for manufacture and marketing.

2. The lid of claim 1 where the position of said cooling air-flow hole is placed in a location of proximity to said drinking hole to facilitate the vacuum action created by sipping from said drinking hole in order to quickly draw the cooler outside ambient air into the cup ahead of the trapped steam vapors and out of said drinking hole along with the hot liquid.

3. The lid of claim 1 where said cooling air-flow hole is located in such a manner and position as to allow time for the thermodynamics of lowering the absolute temperature of the hot liquid to take effect by drawing the cooler outside ambient air over the higher temperature liquid as the liquid is sipped.

4. The lid of claim 1 where the location of said cooling air-flow hole is limited to an arced area in said angular recessed portion of which the optimum location of said cooling air-flow hole is at the base of said angular recessed portion and in line along the radius on which said drinking hole is located.

* * * * *